United States Patent [19]

De Asis

[11] 4,364,174

[45] Dec. 21, 1982

[54] APPARATUS AND IMPROVED METHOD OF MANUFACTURING HANDLES FOR BUTTERFLY DEFENSE KNIFE

[76] Inventor: Lester De Asis, 3040 Ingledale Ter., Los Angeles, Calif. 90039

[21] Appl. No.: 257,911

[22] Filed: Apr. 27, 1981

[51] Int. Cl.[3] ..... B26B 3/06

[52] U.S. Cl. ..... 30/153; 76/104 R

[58] Field of Search ..... 30/153, 154, 164; 76/104 R, 106

[56] References Cited

U.S. PATENT DOCUMENTS

| | | | |
|---|---|---|---|
| 124,566 | 3/1872 | Garrick | 30/153 X |
| 229,706 | 7/1880 | Jansen | 30/153 |
| 365,086 | 6/1887 | Miller | 30/153 |
| 881,294 | 3/1908 | Billings | 30/153 |
| 1,659,418 | 2/1928 | Werner | 30/153 |
| 1,665,955 | 4/1928 | Gatewood | 30/153 |
| 2,714,249 | 8/1955 | Clark | 30/153 |
| 4,330,937 | 5/1982 | Cope | 30/153 |

*Primary Examiner*—Jimmy C. Peters

*Attorney, Agent, or Firm*—Thomas I. Rozsa

[57] ABSTRACT

An improved method of manufacturing the handle sections of a butterfly knife through a selected series of steps by specifically machining each handle section from a single piece of raw stock to produce a handle of superior strength, superior gripping means, and light weight.

27 Claims, 15 Drawing Figures

APPARATUS AND IMPROVED METHOD OF MANUFACTURING HANDLES FOR BUTTERFLY DEFENSE KNIFE

BACKGROUND OF THE INVENTION

The history of knife making begins with the dawn of mankind itself. The very earliest relics found in association with ancient man include edged weapons with which primitive man sought to defend himself, and use to provide food, clothing, and shelter for his family.

A knife sheathed on a belt or strap and prominently displayed on the wearer is appropriate for hunting and woodland hiking, where the knife may be used to mark a trail or to skin an animal which has been shot as a trophy or for food. The famous Bowie knife invented by Jim Bowie in the late 1820's is an example of such a knife. This knife was used by frontiersmen through much of the 19th and early 20th century. However, the wearing of a prominently displayed knife of this type may be frowned on in other circumstances and may also be considered in poor taste. Additionally, it exposes the weapon to a potential attacker well before the victim may realize that he is under attack and have an opportunity to bring the knife into defensive use.

While carrying a concealed defense knife may also be frowned upon in some circumstances, in view of the high crime rate in today's urban environment, it is proper for an individual to carry a concealed knife to be used in self defense and ward off an attacker. In recent history, concealment defense knives have been known in the prior art for many hundreds of years.

A common type of concealment defense knife which has been used was the sheath style dagger which was carried beneath the cloak or in the boot. In these types of knives, the blade was not capable of concealment by the handle, but instead had to be housed in a separate sheath. Conventional jack knives are also used for this purpose. These knives ordinarily have one or more blades pivoted at their proximal ends to one of the extreme ends of the jack knife housing that constitutes a handle.

The easiest knife to conceal and by far the most popular is the folder. To conceal and carry, it only needs to be slipped in the pocket, although some state laws may require it to be sheathed openly on the belt. The folder has been used as a hideout weapon at least since the early nineteenth century. Although folders have been around for centuries, it required certain advances in the art to make them suitable as weapons. The blade has to open easily and then lock in position. One early example was the rocker-locked folding dirk. At the turn of this century, the switchblade was identified as the archetypal folding knife.

A dramatic type of folding knife which is of great value as a defense weapon is a type of clasp knife wherein the handle of the knife is made in two sections and can swing around to completely conceal the blade within a channel in the handles. The original concept of such a knife can be traced to U.S. Pat. No. 124,566 issued to Thomas Garrick in 1872. A more direct disclosure of such a knife can be found in U.S. Pat. No. 229,706 on a "Clasp Knife" issued to E. Jansen in 1880. In that patent, the invention consists essentially in adapting the handle to be swung around upon the blade to bare the latter, instead of swinging the latter upon a pivot on the handle. The patent claimed a knife with a handle made in two sections, pivoted at one end to opposite sides of the knife blade and arranged to be rotated upon their pivots to bare or enclose the blade. Although the concept of the overall knife was disclosed, the handle members appear to be of thin and weak construction. An improvement in the handle section was made by G. W. Miller and disclosed in U.S. Pat. No. 365,086 issued to him in 1887. In this invention, the handle is made of sheet metal folded up from a blank that was originally cut or stamped from a sheet of metal. The folded metal provided a handle with a central channel which concealed the knife blade. This handle was also of weak construction as the walls of the metal handle were necessarily thin in order to allow the metal to be folded at right angles to create the channel. A knife utilizing this concept but containing a handle with more substantial construction is disclosed in U.S. Pat. No. 881,294 issued to C. E. Billings in 1908. In this case, the handle consists of two metal tubes with a slot milled along one side of each tube for receiving the edge of the blade. Three other United States Letters Patent which disclose knives with a design of similar concept are Werner U.S. Pat. Nos. 1,659,418 issued in 1928, Gatewood 1,665,955 issued in 1928, and Clark 2,714,249 issued in 1925.

In more recent years, knives embodying this concept were made in the Batangas province of the Philippines during and after World War II. Known as a butterfly folding knife, it was made in jungle workshops from available materials, with metal, baffalo horn or plastic handles. They were constructed of available materials with hand tools in family shops. Therefore, each knife was an individual item which was not a duplicate of any other knife. As a result, there was very little quality control incorporated into the manufacture of these knives.

The construction of the handles of the butterfly folding knives described in the above referenced patents and those made in the Philippines are basically of thin and weak construction. Although useful for simple tasks such as cutting light objects, the inferior construction of the handles makes the above disclosed knives of questionable use as a defense knife. In a completely closed position with the blade fully concealed, the handles are too weak to be used effectively as a club or straight object. When using the knife with the blade in an opened position, the weaker handles can buckle on impact or the blade can easily be broken off at the point where it joins the handle if there is a hard impact.

SUMMARY OF THE PRESENT INVENTION

It has been discovered, according to the present invention, that manufacturing the handle sections of a butterfly knife through a selected series of steps by specifically machining each handle section from a single piece of raw stock in a predetermined fashion produces a knife handle of superior strength. By this method of manufacture, the handle can be used as a stick or club when the knife is in a closed position and also provides a handle of superior strength which will not buckle on impact when the knife is in the opened position and used as a defense weapon.

It has also been discovered, according to the present invention, that manufacturing the handle sections of a butterfly knife so that the handle sections contain gripping means which are tightly fit into recesses within the lateral faces of the handle sections and held in place by dovetails at the edges of the recesses, provides a knife handle of added strength and superior gripping ability. It has additionally been discovered that securing the gripping means by placing epoxy in a multiplicity of partial holes located within the recess of the handle section face as well as along the interior surface of the gripping means provides a bond of superior strength which assures that the gripping means will be held firmly in place.

It has further been discovered, according to the present invention, that manufacturing the handle sections for a butterfly knife by a selected series of steps by specifically machining each handle section from a single piece of raw stock and further skelitonizing the handle by placing a multiplicity of variable sized holes in the lateral faces of the handle section produces a light weight handle which retains most of the strength of a handle section machined out of a single piece of raw stock.

It has additionally been discovered, according to the present invention, that use of a friction fitting means located in the closing latch of a butterfly knife will assure that the two handle sections will remain closed during transportation and also will remain closed to form a handle during use. Additionally, use of a friction fitting means located in the closing latch will prevent the latch from coming in contact with the blade of the knife while the knife is being closed.

It is therefore an object of the present invention to provide a method of manufacturing the handle sections of a butterfly knife which will yield a knife handle of superior strength, and to provide an apparatus therefor.

It is a further object of the present invention to provide a method of manufacturing handle sections of a butterfly knife which will provide a secure gripping means on the handle and further adds to the strength of the handle.

It is still another object of the present invention to provide a method of manufacturing the handle sections of a butterfly knife and apparatus therefor which will yield a lightweight handle that retains most of the strength characteristics of a handle section machined out of a single piece of raw stock.

It is still a further object of the present invention to provide an apparatus in the form of a friction fitting means in the closing latch which will assure that the two handle sections of the butterfly knife will remain together in both the closed and opened position as well as guarding against the latch striking the knife blade when the knife is being swung closed.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

DETAILED DESCRIPTION OF THE PREFERRED EMBODIMENT

Figure 1:
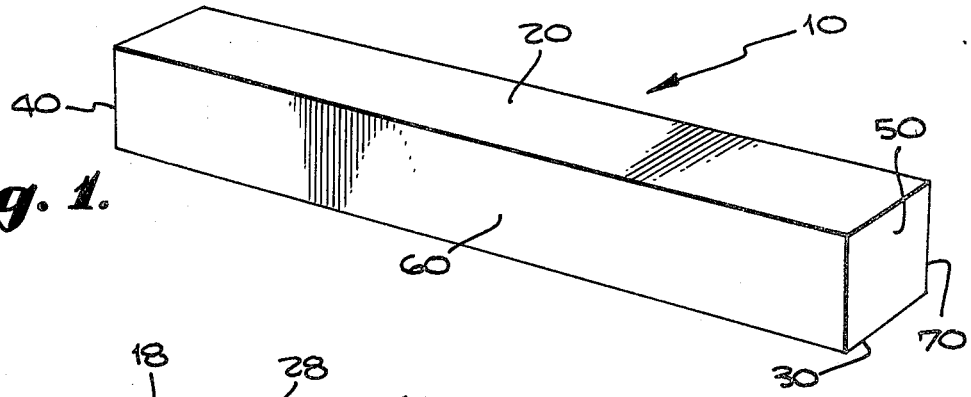
FIG. 1 is a perspective view of a piece of raw stock material.

With reference to the drawings of the invention in detail and more particularly to FIG. 1 through FIG. 5, there is shown the Method of Manufacturing the Improved Handle of the Butterfly Folding Knife. There is shown at 10 a basic piece of raw metal stock. Several types of metal may be utilized, for example steel, brass or aluminum. In the preferred embodiment, either 303 Stainless Sulphur Steel or CDA 360 Alloy Brass is used. A typical piece of raw stock can be seven and one half inches long with a square cross section of five-eights of an inch. A point of novelty in the present invention is the method of manufacturing the handle of the butterfly knife wherein each of the two sections of the handle is completely machined out of a single piece of raw stock. The raw stock 10 has an upper face 20, a lower face 30, a first end face 40, a second end face 50, a first lateral face 60, and a second lateral face 70.

Figure 2:
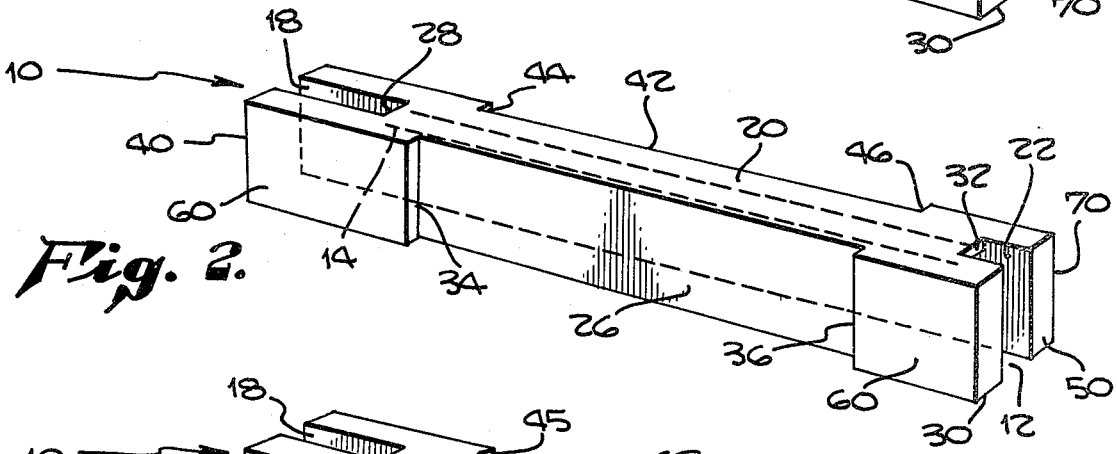
FIG. 2 is a perspective view of the metal after it has gone through the initial stages of machining.
Figure 6:
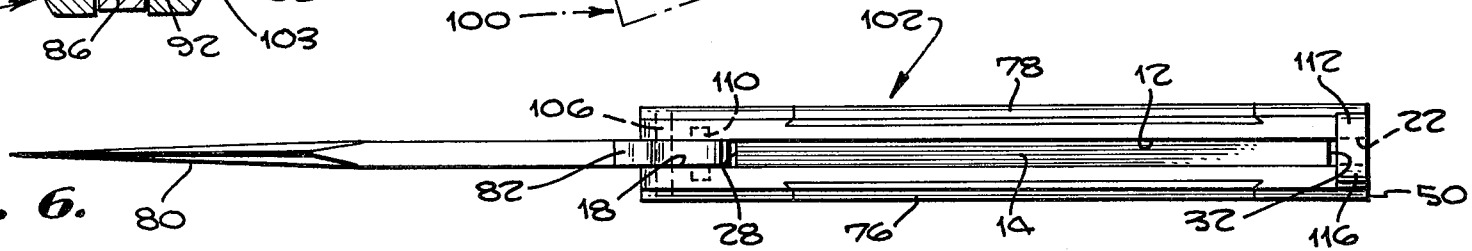
FIG. 6 is a top plan view of the IMPROVED BUTTERFLY FOLDING KNIFE in an opened position.
Figure 10:
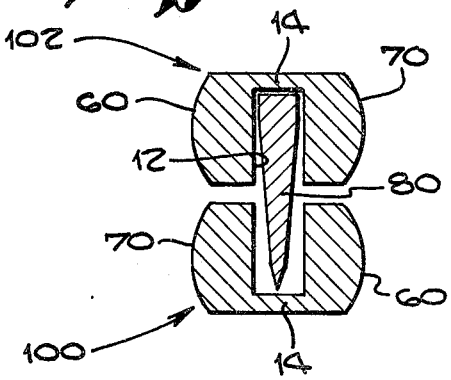
FIG. 10 is a vertical sectional view taken along line 10—10 of FIG. 8.
Figure 12:
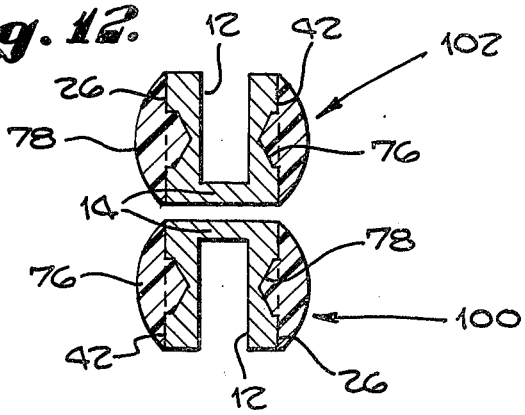
FIG. 12 is a vertical sectional view taken along line 12—12 of FIG. 7.
Figure 13:
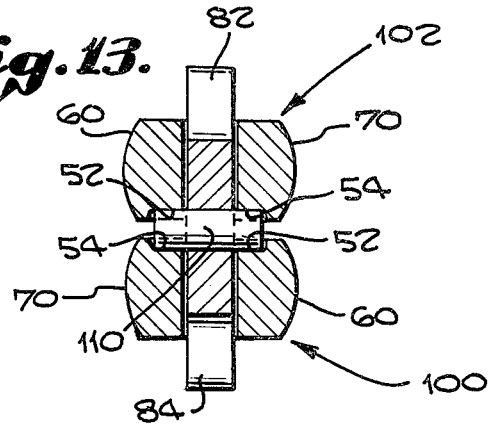
FIG. 13 is a vertical sectional view taken along line 13—13 of FIG. 7.
Figure 11:
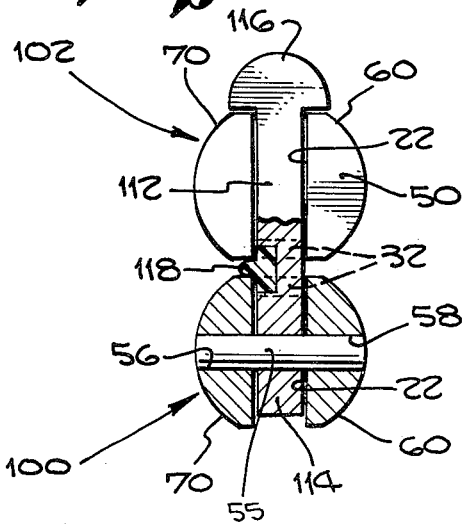
FIG. 11 is a partial elevation vertical sectional view taken along bent line 11—11 of FIG. 7.

The first step of the method of manufacture is illustrated in FIG. 2. The piece of raw stock is cut to the desired length. In the preferred embodiment, this length is five inches. The end faces, 40 and 50 respectively, of the cut raw stock are then squared. In the preferred embodiment, the end faces 40 and 50 will have a square dimension of five eights of an inch on each side. A central longitudinal slot 12 is then cut along the entire length of the stock. In the preferred embodiment, the slot 12 is three sixteenths of an inch wide and extends from the lower face 30 through most of the thickness of the stock, leaving only a thin wall 14 at the upper face 20. The views in FIGS. 2 through 5 show the raw stock with the upper face 20 containing the thin wall 14 on top. The top plan view of FIG. 6 discloses the slot 12 as it runs the entire length of the handle section. The cross-sectional view of FIG. 10 shows the amount of wall 14 left in the upper face 20 relative to the balance of the thickness which is consumed by the slot 12.

A first long transverse slot 18 is cut in the upper face 20 and extends inwardly from first end face 40. In the preferred embodiment, the longitudinal dimension of first transverse slot 18 is thirteen sixteenths of an inch. The first transverse slot 18 is three sixteenths of an inch wide, thereby enabling the slot 12 to extend through the entire thickness of the raw stock 10 along this length. A second short transverse slot 22 is cut in the upper face 20 and extends inwardly from second end face 50. In the preferred embodiment, the longitudinal dimension of second transverse slot 22 is one quarter of an inch. The second transverse slot 22 is also three sixteenths of an inch wide, thereby enabling slot 12 to extend through the entire thickness of raw stock 10 along this length.

A first lateral recess 26 is then machined into first lateral face 60. In the preferred embodiment, the length of first lateral recess 26 is three inches and is equidistant from the inner edge 28 of first long transverse slot 18 and the inner edge 32 of second short transverse slot 22. With the dimensions as given, the distance from inner edge 28 to the first edge 34 of first lateral recess 26 is seven sixteenths of an inch and the distance from inner edge 32 to the second edge 36 of first lateral recess 26 is seven sixteenths of an inch. In the preferred embodiment, first lateral recess 26 is one eighth of an inch deep. A second lateral recess 42 is then machined into second lateral face 70, thereby creating first edge 44 and second edge 46 of the recess. The second lateral recess 42 is parallel to first lateral recess 26 and is also equidistant from inner edge 28 of first long transverse slot 18 and inner edge 32 of second short transverse slot 22. Both lateral recesses are identical in dimensions.

Figure 3:
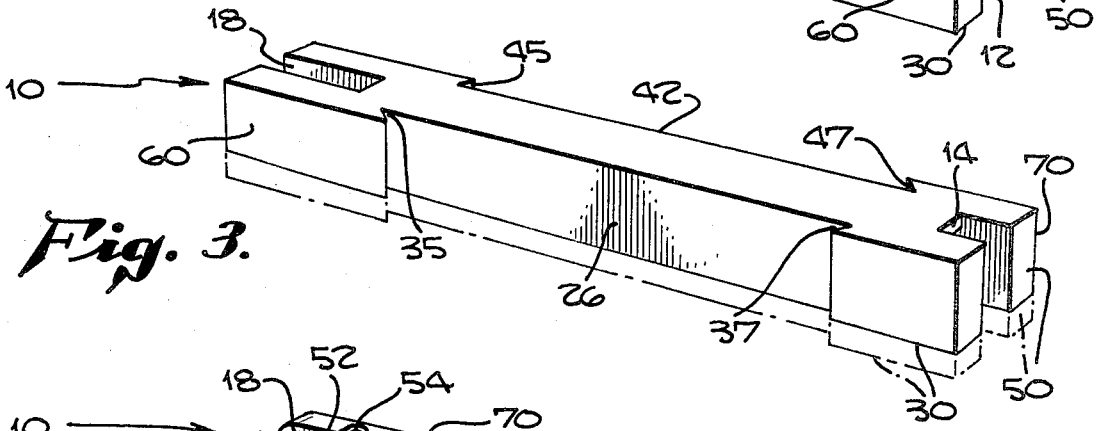
FIG. 3 is a perspective view of the metal after it has gone through additional machining.

The next step in the manufacturing process is to dovetail edges 34 and 36 of first lateral recess 26 and dovetail edges 44 and 46 of second lateral recess 42. This is illustrated in FIG. 3. First dovetail 35 and second dovetail 37 are machined into first edge 34 and second edge 36 respectively of first lateral recess 26. First dovetail 45 and second dovetail 47 are machined into first edge 44 and second edge 46 respectively of second lateral recess 42. In the preferred embodiment, the angle of each dovetail, 35, 37, 45 and 47, will be sixty degrees.

The next manufacturing operation is to taper lower face 30 so that the thickness of said stock 10 decreases from second end face 50 to first end face 40. The taper is made gradually so that in the preferred embodiment of the finished product, the lateral faces 60 and 70 will each be one half inch at its edge adjacent second end face 50 and five sixteenths of an inch at its edge adjacent first end face 40.

Figure 4:
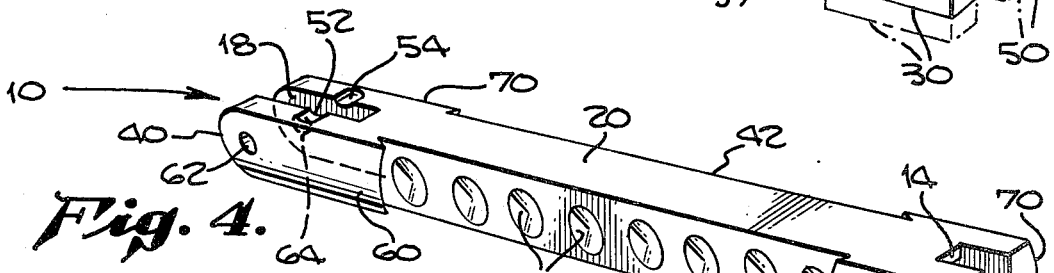
FIG. 4 is a perspective view of the metal near the end of its machining process.
Figure 5:
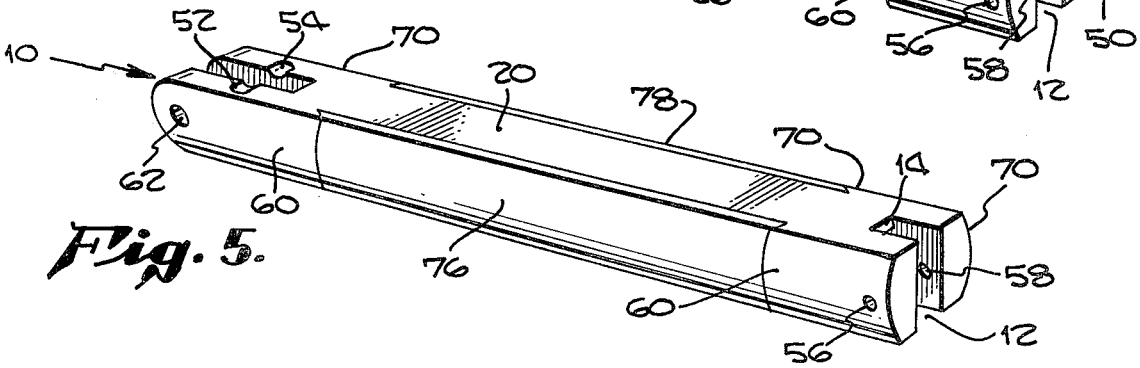
FIG. 5 is a perspective view of the metal after complete machining to form a portion of the knife handle.

FIG. 4 illustrates the final manufacturing steps in machining the stock 10. Lateral faces 60 and 70 are each rounded at their respective edges adjacent second end face 50. In the preferred embodiment, lateral faces 60 and 70 are rounded so that their outer surface forms part of the circumference of a circle which has its central point located at the center of second end face 50. Lateral faces 60 and 70 are rounded for their entire distance from end face 50 to the second edge of lateral recesses 26 and 42 respectively. Second end face 50 is not rounded and remains flat.

Lateral faces 60 and 70 are each rounded at their respective edges adjacent first end face 40. In the preferred embodiment, lateral faces 60 and 70 are rounded so that their outer surface forms part of the circumference of a circle which has its central point located at the center of first end face 40. Lateral faces 60 and 70 are rounded for their entire distance from end face 40 to the first edge of lateral recesses 26 and 42 respectively. The, first end face 40 is rounded.

In the next manufacturing operation, depressions 52 and 54 are machined into upper face 20 along the longitudinal edges of first long transverse slot 18. In the preferred embodiment, depressions 52 and 54 are located at a distance from front end face 40 which is two thirds of the length of first long transverse slot 18.

Small holes 56 and 58 are drilled through lateral faces 60 and 70 respectively, adjacent second end face 50. In the preferred embodiment, holes 56 and 58 are three thirtyseconds of an inch in diameter and are centrally located along the vertical face of lateral faces 60 and 70 respectively.

Large holes 62 and 64 are drilled through lateral faces 60 and 70 respectively, near first end face 40. In the preferred embodiment, holes 62 and 64 are one eighth of an inch in diameter and are centrally located along the vertical face of lateral faces 60 and 70 respectively. In the preferred embodiment, the center of holes 62 and 64 are each located three sixteenths of an inch from first end face 40.

In the next manufacturing operation, a multiplicity of partial holes 72 are machined into first lateral face 60 along the length of its recess 26. A multiplicity of partial holes 74 are machined into second lateral face 70 along the length of its recess 42. In the preferred embodiment, the multiplicity of partial holes 72 and 74 are drilled as deep as possible without breaking through the wall of the recess into slot 12. In the preferred embodiment, nine partial holes 72 are machined into recess 26; each hole being one quarter of an inch in diameter and spaced one thirty-second of an inch apart from the adjacent hole. Nine partial holes are machined into recess 42; each hole being one quarter of an inch in diameter and spaced one thirty-second of an inch apart from the adjacent hole.

At this point, the raw stock 10 has been machined into a handle section 10. The final step is to fit grip piece 76 into recess 26 and fit grip piece 78 into recess 42, and secure them in place. Grip pieces 76 and 78 fit tightly into recesses 26 and 42 respectively. In the preferred embodiment, the grip pieces can be made of a multitude of materials such as micarta, plastic, ivory, or animal horn. The grip pieces are held securely in place by epoxy which is placed in each of the multiplicity of holes 72 and 74 as well as along the entire interior surface of grip pieces 76 and 78. By machining the multiplicity of holes 72 and 74, and placing epoxy in each hole, the grip pieces 76 and 78 are firmly held in place. This firm placement of the grip pieces lends a great deal of structural strength to handle section 10 and also permits the user to have a very secure grip on the butterfly knife. At this point, the entire handle section 10 is cleaned and polished.

The above described method of manufacturing handle section 10 provides a significant improvement over the prior art. An examination of the prior art patents disclosed in the Background of the Invention section shows that none of the handle sections of the knives and tools in those patents are manufactured in this fashion. The Combined Tool in Garrick U.S. Pat. No. 124,566 illustrates a handle of thin walled construction with no special gripping section. No description of its manufacture is discussed. Jansen U.S. Pat. No. 229,706 also illustrates handle sections of thin walled construction with no special gripping section. Once again, manufacture of the handle sections is not discussed. Miller U.S. Pat. No. 365,086 discloses a knife wherein the handle sections are also of thin walled construction. Column 1, lines 48 and following stated "The handle b is made of sheet metal folded up from the blank d, this as cut or stamped from a sheet of metal." Clearly, in order to fold it up, the metal can't be very thick and the construction is at best considerably weaker than the construction of the handle in the present invention. Additionally, there is no special gripping section machined into the handle sections.

Billings U.S. Pat. No. 881,294 discloses a knife with a handle similar in construction to the handle of the knife in the present invention. The only discussion of handle manufacture is found in column 1, lines 45 which says "A slot 7 is milled or otherwise formed along one side of each tube for receiving the edge of the blade." There is no special gripping section in the handle and the strength of the handle in Billings is at least open to question. Werner U.S. Pat. No. 1,659,418 discloses a thin knife handle with no special gripping section. No discussion of the handle manufacture is made and the strength of this handle is also open to question. Similarly, Gatewood U.S. Pat. No. 1,665,955 simply states in Column 1, line 47 "Each handle section is in the form of a U-shaped channel . . . ". There is no discussion of handle manufacture and the handle appears to be of thin and weak construction. There is also no separate gripping section in the handle. Finally, Clark U.S. Pat. No. 2,714,249 only discusses the handle manufacture in Column 2, line 3 which states: "Each handle segment 23 is provided with a back wall 24 which terminates spaced from the ends of the side walls 20 and are provided with forward end faces 25 which are adapted to bear against the recessed rear edge portion 16 of the butt 14, thus creating a longitudinal pressure on the rear edge 16 and binding the blade for rigid support by the handle." The handle construction is different from that of the present invention in being of much thinner and weaker construction and not having any gripping section in the handle.

Therefore, the method of manufacturing the handle sections as disclosed above is not taught or made obvious by the prior art. The present method of manufacture provides a handle of superior strength for use as a club or stick when the knife is in a closed position and for use as a superior handle when the knife is in an open position. The gripping pieces are firmly held in place by the multiplicity of holes in the recessed sections and lends added strength to the handle as well as provide a superior gripping means for the user. The lateral faces 60 and 70 were rounded to form a part of the circumference of a circle that has its central point at the center of the handle edges so that the knife can be twirled in a circular motion while one section alone is held in the hand. This intimidating gesture is of great value in discouraging attack by an aggressor.

Figure 15:
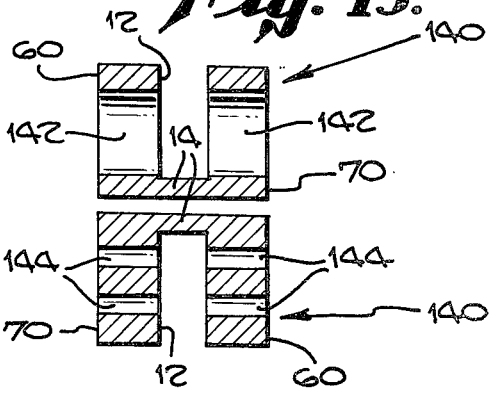
FIG. 15 is a partial elevation vertical sectional view taken along bent line 15—15 of FIG. 14.
Figure 14:
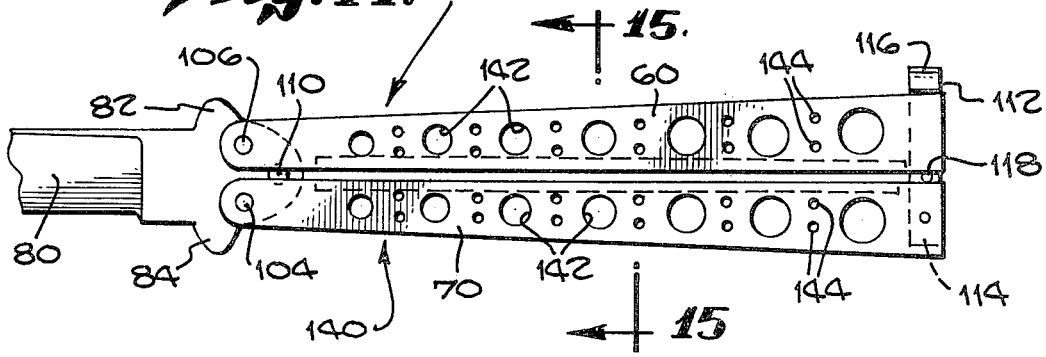
FIG. 14 is a partial side sectional view of another embodiment of the IMPROVED BUTTERFLY FOLDING KNIFE in an opened position.

Another embodiment of the improved handle section 10 is shown in FIGS. 14 and 15. In this skeletonized handle section 140, the method of manufacture is identical to that described above except that recesses 26 and 42 are eliminated and the multiplicity of holes 72 and 74 in recesses 26 and 42 respectively are eliminated. Further, lateral faces 60 and 70 remain flat and are not rounded at any portion. The purpose of this skelitonized handle section design is to provide a handle of significantly lighter weight while retaining most of the strength embodied in the handle section manufacture discussed above.

In keeping with the intent of lighter weight, a multiplicity of variable sized large holes 142 are drilled into lateral faces 60 and 70. The holes extend through the entire thickness of the handle section and into longitudinal slot 12. In the preferred embodiment, seven large holes 142 varying from three sixteenths to five sixteenths of an inch in diameter are drilled in each lateral face. Interspersed between large holes 142 are small double hole sets 144. In the preferred embodiment, these holes are one sixteenth of an inch in diameter and are evenly spaced between the large holes. These small double hole sets 144 also extend through the entire thickness of the handle section and into longitudinal slot 12.

The manufacture of a handle with this design does not provide a sure gripping means as in the previously discussed design and also is not as strong as the handle section in the previously discussed design. However, it does provide a handle section of significantly lighter weight while incorporating many of the previously discussed advantages in the manufacture of the handle section. In the preferred embodiment, the skelitonized handle section 140 is made entirely of stainless steel. Other metals such as brass or aluminum can also be used.

Two identical handle sections 10 are used to form the left and right sections of the butterfly knife handle (or upper and lower sections). The present invention employs a number of comercially manufactured blades for the knife blade portion. In the preferred embodiment, the standard blade is a four inch hollow ground clip point made of 150CM stainless steel. In the preferred embodiment a single edged blade is used although the knife can accommodate a double edged blade.

Figure 7:
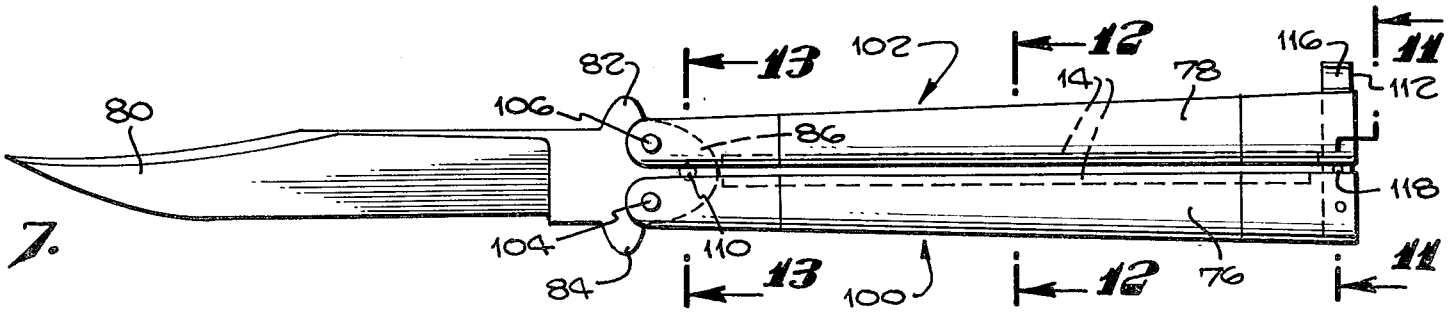
FIG. 7 is a side elevational view of the IMPROVED BUTTERFLY FOLDING KNIFE in an opened position.

A side elevational view of the butterfly knife in an opened position is shown in FIG. 7. The knife blade 80 contains a pair of guards 82 and 84 and a short tang 86, all formed in a one piece construction. The knife blade 80 also contains spaced holes 92 and 94 in its tang portion and central hole 96 near the base of the tang. These elements are also shown in the side sectional view of the butterfly knife in a closed and partially closed position in FIG. 8.

For purposes of the following discussion and referring to FIGS. 6 through 13, the handle section 10 shall be referred to as lower handle section 100 which sheaths the edge of the knife blade and upper handle section 102 which sheaths the rear portion of the knife blade. Lower handle section 100 is connected to the knife blade by means of hinge pin 104 which passes through large holes 62 and 64 in the handle section and through hole 92 in the tang portion 86 of the knife blade 80. Upper handle section 102 is connected to the knife blade by means of hinge pin 106 which passes through large holes 62 and 64 in the handle section and through hole 94 in the tang portion 86 of the knife blade 80.

Figure 9:
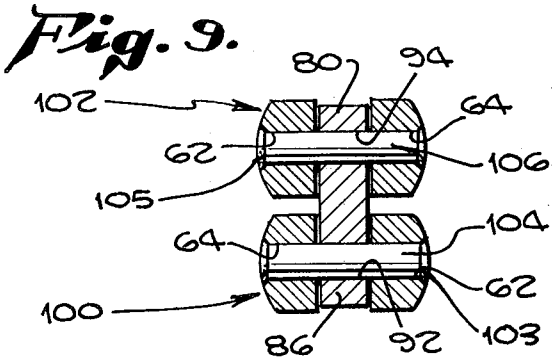
FIG. 9 is a vertical sectional view taken along line 9—9 of FIG. 8.

The hinge pins are then secured in place. If the handle sections 100 and 102 are made of nonferrous metals or other soft metals such as brass or aluminum, the hinge pins 104 and 106 can be riveted in place. Due to the softness of brass or aluminum, an interior rivet head can be formed between the exterior surface of the handle sections. The pressure of the tang 86 against the handle sections will cause the opposite edges of each handle section in the area of the tang to spread apart over time. The inner diameter of holes 62 and 64 in the handle section of the soft metals will open up to allow the rivet head to be expanded in the subsurface area and accommodate the pressure of the tang 86. The cross-sectional view in FIG. 9—9 shows rivets 103 and 105 securing hinge pins 104 and 106 respectively.

In the event that a hard metal such as stainless steel, titanium, or another ferrous metal is used for the handle sections 100 and 102, riveting would not be effective.

The inner diameter of the holes 62 and 64 in the hard metal will not spread to accommodate the pressure from the tang 86. Over a period of time the opposite edges of the handle sections which surround the tang 86 will spread apart. As a result, the hinge pins 104 and 106 will become visible adjacent the tang 86 and this is cosmetically detracting. In addition, this creates a point of structural weakness in the area of the hinge pins 104 and 106, and on impact the knife blade 80 could come apart from handle sections 100 and 102. To eliminate this problem, a heliarc welding process instead of riveting is used to secure hinge pins 104 and 106. First, hinge pins 104 and 106 are press fit respectively into the holes 62 and 64 in the handle sections. The hinge pins are fused to the holes by heliarc welding. The hinge pins then become integral with the handle sections. A bead made of metal such as 304 stainless steel is used in this process. The holes 62 and 64 are then filled up entirely with the 304 stainless steel bead during the welding process. The area is then ground flush to be in a smooth finish with the exterior surfaces of handle sections 100 and 102.

Figure 8:
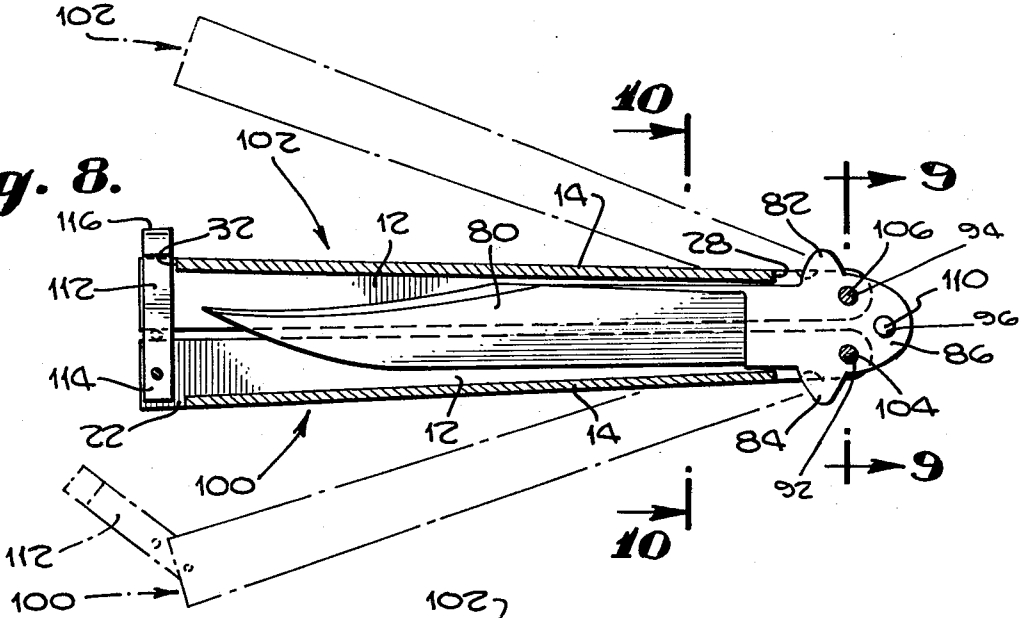
FIG. 8 is a side sectional view of the IMPROVED BUTTERFLY FOLDING KNIFE in a partially closed position and in a completely closed position.

The handle sections 100 and 102 are mounted so that longitudinal slot 12 faces outwardly and the upper face 20 of each handle section faces inwardly when the knife is in an open position. The knife blade 80 is mounted so that its tang portion 86 fits within long transverse slot 18 of each handle section. As shown in FIG. 8, the handle sections 100 and 102 can be swung around 180 degrees to completely enclose the knife blade within the slot 12 of each handle section. A tang pin 110 is glued or riveted in place in central hole 96. This tang pin 110 is designed to fit into depressions 52 and 54 in upper face 20 of each handle section. In this manner, the tang pin 110 prevents the two handle sections from touching each other when the knife is in an open position. The above-described construction of hinge pin attachment and tang pin is not unique and is disclosed in the Hansen and Billings patent described and identified above.

A latch 112 is located adjacent the second end face 50 of lower handle section 100. The latch contains an elongated portion 114 and a crossbar tip 116. A hole in the elongated portion 114 is aligned with small holes 56 and 58 in one handle section and held in place by a hinge pin 55 which is riveted in place. The latch 112 is designed so that its crossbar tip 116 will come in contact with the outward facing surface of the handle section which does not hold the latch in place, so that the two handle sections are held together. This is illustrated in FIG. 8 for the knife in a closed position and in FIGS. 7 and 11 for the knife in an opened position. The use of a latch of this general configuration is disclosed in Billings U.S. Pat. No. 881,294. However, a point of novelty in the present invention consists in the use of a friction fitting means placed into the elongated section 114 of latch 112. A hole is drilled into the elongated section 114 and extends approximately three quarters into the thickness of the elongated portion 114. The friction fitting means 118 is then placed into the hole so that it protrudes approximately one-eighth of an inch from one longitudinal surface of elongated portion 114 and fits directly over upper surface 20 of the handle section holding the latch 112. In the preferred embodiment, the friction fitting means 118 is made of nylon. Another friction fitting means which can be used is a ball and spring assembly. The friction fitting means 118 provides a solid close fit and assures that the handles will not fly open while the knife is carried in a closed position in a pocket or other container. The crossbar tip 116 alone does not assure this tight security. When the knife is in an open position, the friction fitting means 118 assures that the two handle sections will remain together and not fly apart on impact. The crossbar tip 116 helps to retain the two handle sections together but on impact, it can fly off the surface where it comes in contact with a handle section. The friction fitting means prevents this from occurring. Finally, as the knife is swung closed, the friction fitting means 118 blocks the latch 112 from falling into the plane of slot 12 and hitting the knife blade 80. This prevents damage to both the edge of the knife blade 80 and the latch 112.

As previously stated, another embodiment of the improved handle section 10 is shown in FIGS. 14 and 15. In addition to the novel method of manufacture, the apparatus of the skeletonized handle section is also unique. None of the prior art patents cited above either disclose, teach or make obvious the use of a skeletonized handle section wherein the handle is lightened by a multiplicity of large and small holes in the lateral faces of the handle sections. The variable sized large holes 142 and the small double hole sets 144 extend through the entire thickness of the knife handle section. Since substantial metal remains between the holes, the inherent strength of the one piece machined construction is retained, while the holes significantly lighten the weight of the handle.

A novel feature of the present invention is a method of manufacturing the handle sections for a butterfly knife and an apparatus therefor, wherein the handle sections are specifically machined from a single piece of raw stock in a predetermined fashion to provide a knife handle of superior strength for use as a defense weapon.

A further novel feature of the present invention is a method of manufacturing the handle sections for a butterfly knife and an apparatus therefor, wherein the handle sections contain gripping means which are tightly fit into dovetails in the lateral faces of the handle sections and securely held in place by means of epoxy placed in a multiplicity of holes located within the recess of the handle section face where the gripping means is located.

An additional novel feature of the present invention is a method of manufacturing the handle sections for a butterfly knife wherein the handle sections are of skeletonized design to provide a handle of significantly reduced weight while still incorporating many features of a strong knife handle.

A further novel feature of the present invention is the design of a skeletonized knife handle wherein the handle has a multiplicity of large and small holes through its lateral faces, to reduce the weight of the handle sections.

An additional novel feature of the present invention is the use of a friction fitting means located in the closing latch of the butterfly knife, to assure that the handle sections will remain closed during transportation and closed to form a handle during use, and to further prevent said latch from coming in contact with the blade of the knife while the knife is being closed.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus and methods shown is intended only for illustration and for disclosure of an operative embodiment and method of manufacture and not to show all of the various forms of modification in which the invention might be embodied or manufactured.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A method of manufacturing each of the two handle sections of a butterfly knife wherein each handle section is machined from a single piece of rectangular raw stock which contains an upper face and a lower face, a first end face and a second end face, and a first lateral face and a second lateral face, which comprises:

a. cutting said piece of raw stock to a selected length;
b. squaring said first end face to a selected dimension;
c. squaring said second end face to a selected dimension;
d. machining a central longitudinal slot in the longitudinal lower face of said piece of raw stock such that the central longitudinal slot extends along the entire length of the lower face and extends transversely through most of the depth of said piece of raw stock;
e. cutting a first transverse slot in the central portion of said first end face such that the first transverse slot extends inwardly to a selected longitudinal distance along said upper face of said piece of raw stock and coincides with said central longitudinal slot along the lateral depth of said raw stock;
f. cutting a second transverse slot in the central portion of said second end face such that the second transverse slot extends inwardly to a selected longitudinal distance along said upper face of said piece of raw stock and coincides with said central longitudinal slot along the lateral depth of said raw stock;
g. machining a first lateral recess to a selected depth into said first lateral face of said piece of raw stock such that the first lateral recess extends transversely through the entire height of the first lateral face and extends longitudinally along the central portion of the first lateral face, beginning at a first recess edge and terminating in a second recess edge;
h. machining a dovetail into said first recess edge and into said second recess edge of said first lateral recess;
i. machining a second lateral recess to a selected depth into said second lateral face of said piece of raw stock such that the second lateral recess extends transversely through the entire height of the second lateral face and extends longitudinally along the central portion of the second lateral face, beginning at a first recess edge and terminating in a second recess edge;
j. machining a dovetail into said first recess edge and into said second recess edge of said second lateral recess;
k. tapering said lower face such that said piece of raw stock is tapered a selected amount from said second end face to said first end face;
l. rounding the surfaces of said first and said second lateral faces adjacent said second end face such that the surfaces of said first and second lateral faces form part of the circumference of a circle which has its central point located at the center of said second end face;
m. rounding the surfaces of said first and said second lateral faces adjacent said first end face such that the surfaces of said first and second lateral faces form part of the circumference of a circle which has its central point located at the center of said first end face;
n. rounding said first end face;
o. machining a depression into said upper face along each edge of said first transverse slot;
p. drilling a central hole through said first and said second lateral face adjacent said second end face;
g. drilling a central hole through said first and said second lateral face near said first end face;
r. machining a multiplicity of partial holes into said first lateral recess such that said holes are aligned along the entire length of said first lateral recess and do not penetrate the lateral wall of said piece of raw stock so as not to come in contact with said central longitudinal slot;
s. machining a multiplicity of partial holes into said second lateral recess such that said holes are aligned along the entire length of said second lateral recess and do not penetrate the lateral wall of said piece of raw stock so as not to come in contact with said central longitudinal slot;
t. cutting a first piece of material to the exact interior dimensions of said first lateral recess;
u. securing said first piece of material into said first lateral recess by applying adhesive material into each of said multiplicity of partial holes in the recess and along the interior surface of the first piece of material;
v. cutting a second piece of material to the exact interior dimensions of said second lateral recess; and
w. securing said second piece of material into said second lateral recess by applying adhesive material into each of said multiplicity of partial holes in the recess and along the interior surface of the second piece of material;
x. whereby two such machined pieces of raw stock are used to form handle sections of a knife and are attached through said holes in their lateral faces near said first end face to the tang of a knife blade to form the handle of the knife such that the knife blade is completely concealed within said central longitudinal slot of each handle section when the knife is in a closed position and form the handle of the knife by having their upper faces adjacent each other when the knife is in an opened position.

2. A method of manufacturing each of the two light weight handle sections of a butterfly knife wherein each handle section is machined from a single piece of rectangular raw stock which contains an upper face and a lower face, a first end face and a second end face, and a first lateral face and a second lateral face, which comprises:

a. cutting said piece of raw stock to a selected length;
b. squaring said first end face to a selected dimension;
c. squaring said second end face to a selected dimension;
d. machining a central longitudinal slot in the longitudinal lower face of said piece of raw stock such that the central longitudinal slot extends along the entire length of the lower face and extends transversely through most of the depth of said piece of raw stock;

e. cutting a first transverse slot in the central portion of said first end face such that the first transverse slot extends inwardly to a selected longitudinal distance along said upper face of said piece of raw stock and coincides with said central longitudinal slot along the lateral depth of said raw stock;

f. cutting a second transverse slot in the central portion of said second end face such that the second transverse slot extends inwardly to a selected longitudinal distance along said upper face of said piece of raw stock and coincides with said central longitudinal slot along the lateral depth of said raw stock;

g. tapering said lower face such that said piece of raw stock is tapered a selected amount from said second end face to said first end face;

h. rounding said first end face;

i. machining a depression into said upper face along each edge of said first transverse slot;

j. drilling a central hole through said first and said second lateral face adjacent said second end face;

k. drilling a central hole through said first and said second lateral face near said first end face;

l. drilling a multiplicity of variable sized large holes into said first lateral face such that the large holes are aligned along the longitudinal axis of said first lateral face and extend through the entire thickness of said first lateral face and into said central longitudinal slot;

m. drilling a multiplicity of small holes into said first lateral face such that the small holes are interspersed between said variable sized large holes and also extend through the entire thickness of said first lateral face and into said central longitudinal slot;

n. drilling a multiplicity of variable sized large holes into said second lateral face such that the large holes are aligned along the longitudinal axis of said second lateral face and extend through the entire thickness of said second lateral face and into said central longitudinal slot; and o. drilling a multiplicity of small holes into said second lateral face such that the small holes are interspersed between said variable sized large holes and also extend through the entire thickness of said second lateral face and into said central longitudinal slot;

p. whereby two such machined pieces of raw stock are used to form light weight handle sections of a knife and are attached through said holes in their lateral faces near said first end face to the tang of a knife blade to form the light weight handle of the knife such that the knife blade is completely concealed within said central longitudinal slot of each handle section when the knife is in a closed position and form the handle of the knife by having their upper faces adjacent each other when the knife is in an opened position.

3. A handle section for use as part of the two section handle of a butterfly knife wherein each section comprises:

a. a longitudinal upper face;

b. a longitudinal lower face;

c. a first end face;

d. a second end face;

e. a first lateral face;

f. a second lateral face;

g. a central longitudinal slot in said longitudinal lower face extending along the entire length of said longitudinal lower face and extending transversely through most of the depth of said section;

h. a first transverse slot in the central portion of said first end face wherein the first transverse slot extends inwardly to a selected longitudinal distance along said longitudinal upper face and coincides with said central longitudinal slot;

i. a second transverse slot in the central portion of said second end face wherein the second transverse slot extends inwardly to a selected longitudinal distance along said longitudinal upper face and coincides with said central longitudinal slot;

j. said first lateral face containing a first lateral recess therein, wherein the recess extends transversely through the entire height of the first lateral face and extends longitudinally along the central portion of the first lateral face, beginning at a first recess edge and terminating in a second recess edge;

k. said first recess edge in said first lateral face being dovetailed;

l. said second recess edge in said first lateral face being dovetailed;

m. said second lateral face containing a second lateral recess therein, wherein the recess extends transversely through the entire height of the second lateral face and extends longitudinally along the central portion of the first lateral face, beginning at a first recess edge and terminating in a second recess edge;

n. said first recess edge in said second lateral face being dovetailed;

o. said second recess edge in said second lateral face being dovetailed.

p. said longitudinal lower face being tapered from said second end face to said first end face;

q. said first and said second lateral faces adjacent said second end face being rounded such that the surfaces of said first and second lateral faces form part of the circumference of a circle which has its central point located at the center of said second end face;

r. said first and said second lateral faces adjacent said first end face being rounded such that the surfaces of said first and second lateral faces form part of the circumference of a circle which has its central point located at the center of said second end face;

s. said first end face being rounded;

t. said upper face containing a depression along each edge of said first transverse slot;

u. said first and said second lateral faces containing a central hole through their entire thickness adjacent said second end face;

v. said first and said second lateral faces containing a central hole through their entire thickness near said first end face;

w. said first lateral recess containing a multiplicity of partial holes, wherein said holes are aligned along the entire length of said first lateral recess and do not penetrate the lateral wall of said recess so as not to come in contact with said central longitudinal slot;

x. said second lateral recess containing a multiplicity of partial holes, wherein said holes are aligned along the entire length of said second lateral recess and do not penetrate the lateral wall of said recess so as not to come in contact with said central longitudinal slot;

y. said first lateral recess containing gripping means therein;

z. said second lateral recess containing gripping means therein; and aa. said gripping means having associated therewith adhesive material which rigidly attaches said gripping means into said first and said second lateral recesses, wherein said adhesive material is placed into each of said multiplicity of partial holes and along the interior surface of said gripping means;

bb. whereby two such sections become handle sections of a knife and are attached through said holes in their lateral faces near said first end to the tang of a knife blade to form the light weight handle of the knife such that the knife blade is completely concealed within said central longitudinal slot of each handle section when the knife is in a closed position and form the handle of the knife by having their upper faces adjacent each other when the knife is in an opened position.

4. A light weight handle section for use as part of the two section handle of a butterfly knife wherein each section comprises:

a. a longitudinal upper face;

b. a longitudinal lower face;

c. a first end face;

d. a second end face;

e. a first lateral face;

f. a second lateral face;

g. a central longitudinal slot in said longitudinal lower face extending along the entire length of said longitudinal lower face and extending transversely through most of the depth of said section.

h. a first transverse slot in the central portion of said first end face wherein the first transverse slot extends inwardly to a selected longitudinal distance along said longitudinal upper face and coincides with said central longitudinal slot;

i. a second transverse slot in the central portion of said second end face wherein the second transverse slot extends inwardly to a selected longitudinal distance along said longitudinal upper face and coincides with said central longitudinal slot;

j. said longitudinal lower face being tapered from said second end face to said first end face;

k. said first end face being rounded;

l. said upper face containing a depression along each edge of said first transverse slot;

m. said first and said second lateral faces containing a central hole through their entire thickness adjacent said second end face;

n. said first and said second lateral faces containing a central hole through their entire thickness near said first end face;

o. said first lateral face containing a multiplicity of variable sized large holes along its longitudinal axis, wherein the large holes extend through the entire thickness of said first lateral face and into said central longitudinal slot;

p. said first lateral face containing a multiplicity of small holes interspersed between said variable sized large holes and also extending through the entire thickness of said first lateral face and into said central longitudinal slot;

q. said second lateral face containing a multiplicity of variable sized large holes along its longitudinal axis, wherein the large holes extend through the entire thickness of said second lateral face and into said central longitudinal slot; and r. said second lateral face containing a multiplicity of small holes interspersed between said variable sized large holes and also extending through the entire thickness of said second lateral face and into said central longitudinal slot;

s. whereby two such sections become light weight handle sections of a knife and are attached through said holes in their lateral faces near said first end to the tang of a knife blade to form the light weight handle of the knife such that the knife blade is completely concealed within said central longitudinal slot of each handle section when the knife is in a closed position and form the handle of the knife by having their upper faces adjacent each other when the knife is in an opened position.

5. The invention as defined in claim 3, further comprising:

a. a latch member;

b. said latch member containing an elongated rectangular section and a crossbar section attached perpendicular to the elongated rectangular section at a first end face;

c. said elongated rectangular section containing a hole through its lateral face at a distance approximately one quarter the length of said elongated rectangular section from its second end face which is opposite said crossbar section;

d. said latch being rotatably attached to one of said handle sections by hinge pin means placed through said hole in said elongated rectangular section and through said central hole in said first and said second lateral faces adjacent said second end face;

e. said elongated rectangular section containing a partial hole in one lateral face located at approximately the longitudinal center of the elongated rectangular section; and f. said partial hole containing friction fitting means which protrudes therefrom;

g. whereby said latch is used to keep the two handle sections closed when the knife is in an open or closed position by having said friction fitting means lie between the two handle sections and said crossbar section lie across the longitudinal lower or upper face of the handle section not holding said elongated rectangular section of said latch.

6. The invention a defined in claim 4, further comprising:

a. a latch member;

b. said latch member containing an elongated rectangular section and a crossbar section attached perpendicular to the elongated rectangular section at a first end face;

c. said elongated rectangular section containing a hole through its lateral face at a distance approximately one quarter the length of said elongated rectangular section from its second end face which is opposite said crossbar section;

d. said latch being rotatably attached to one of said handle sections by hinge pin means placed through said hole in said elongated rectangular section and through said central hole in said first and said second lateral faces adjacent said second end face;

e. said elongated rectangular section containing a partial hole in one lateral face located at approximately the longitudinal center of the elongated rectangular section; and f. said partial hole containing friction fitting means which protrudes therefrom;

g. whereby said latch is used to keep the two handle sections closed when the knife is in an open or closed position by having said friction fitting means lie between the two handle sections and having said crossbar section lie across the longitudinal lower or upper face of the handle section not holding said elongated rectangular section of said latch.

7. The invention as defined in claim 1 wherein said rectangular raw stock is made of stainless steel.

8. The invention as defined in claim 1 wherein said rectangular raw stock is made of brass.

9. The invention as defined in claim 2 wherein said rectangular raw stock is made of stainless steel.

10. The invention as defined in claim 2 wherein said rectangular raw stock is made of brass.

11. The invention as defined in claim 3 wherein said handle section is made of stainless steel.

12. The invention as defined in claim 3 wherein said handle section is made of brass.

13. The invention as defined in claim 4 wherein said handle section is made of stainless steel.

14. The invention as defined in claim 4 wherein said handle section is made of brass.

15. The invention as defined in claim 3 wherein said gripping means is made of micarta.

16. The invention as defined in claim 5 wherein said friction fitting means is made of nylon.

17. The invention as defined in claim 6 wherein said friction fitting means is made of nylon.

18. The invention as defined in claim 5 wherein said friction fitting means consists of a ball and socket assembly.

19. The invention as defined in claim 6 wherein said friction fitting means consists of a ball and socket assembly.

20. The invention as defined in claim 7 wherein said two machined pieces of stainless steel raw stock which are used to form handle sections of a knife are attached through said holes in their lateral faces near said first end face to the tang of a knife blade by means of hinge pins which pass through the holes in the handle section, through a hole in said tang, and are heliarc welded in place.

21. The invention as defined in claim 8 wherein said two machined pieces of brass raw stock which are used to form handle sections of a knife are attached through said holes in their lateral faces near said first end face to the tang of a knife blade by means of hinge pins which pass through the holes in the handle section, through a hole in said tang, and are riveted in place.

22. The invention as defined in claim 9 wherein said two machined pieces of stainless steel raw stock which are used to form handle sections of a knife are attached through said holes in their lateral faces near said first end face to the tang of a knife blade by means of hinge pins which pass through the holes in the handle section, through a hole in said tang, and are heliarc welded in place.

23. The invention as defined in claim 10 wherein said two machined pieces of brass raw stock which are used to form handle sections of a knife are attached through said holes in their lateral faces near said first end face to the tang of a knife blade by means of hinge pins which pass through the holes in the handle section, through a hole in said tang, and are riveted in place.

24. The invention as defined in claim 11 wherein said two machined pieces of stainless steel raw stock which are used to form handle sections of a knife are attached through said holes in their lateral faces near said first end face to the tang of a knife blade by means of hinge pins which pass through the holes in the handle section, through a hole in said tang, and are heliarc welded in place.

25. The invention as defined in claim 12 wherein said two machined pieces of brass raw stock which are used to form handle sections of a knife blade are attached through said holes in their lateral faces near said first end face to the tang of a knife blade by means of hinge pins which pass through the holes in the handle section, through a hole in said tang, and are riveted in place.

26. The invention as defined in claim 13 wherein said two machined pieces of stainless steel raw stock which are used to form handle sections of a knife are attached through said holes in their lateral faces near said first end face to the tang of a knife blade by means of hinge pins which pass through the holes in the handle section, through a hole in said tang, and are heliarc welded in place.

27. The invention as defined in claim 14 wherein said two machined pieces of brass raw stock which are used to form handle sections of a knife are attached through said holes in their lateral faces near said first end face to the tang of a knife blade by means of hinge pins which pass through the holes in the handle section, through a hole in said tang, and are riveted in place.

* * * * *